United States Patent [19]

Hoogland

[11] Patent Number: 4,870,232

[45] Date of Patent: Sep. 26, 1989

[54] EXTENSION CONTROL FOR A SWITCH

[76] Inventor: John A. Hoogland, P.O. Box 8072, Green Bay, Wis. 54308

[21] Appl. No.: 229,282

[22] Filed: Aug. 8, 1988

[51] Int. Cl.[4] ..... H01H 3/04

[52] U.S. Cl. ..... 200/331; 200/313; 200/338; 200/544; 200/503

[58] Field of Search ..... 200/330–332, 200/338, 337, 335, 310, 313, 315; 74/544, 503

[56] References Cited

U.S. PATENT DOCUMENTS

| | | | |
|---|---|---|---|
| D. 274,972 | 8/1984 | Mann, Jr. | D8/14 |
| 2,187,846 | 8/1937 | Williams | 200/161 |
| 2,257,033 | 9/1941 | Bissell | 200/331 |
| 2,368,926 | 2/1945 | Jeffrey | 200/331 |
| 2,389,220 | 11/1945 | Tredeau | 200/331 |
| 2,493,581 | 1/1950 | Hood | 200/331 X |
| 2,692,932 | 10/1954 | Parke et al. | 200/331 |
| 2,724,032 | 11/1955 | Colletta | 200/331 |
| 2,726,303 | 12/1955 | Berndsen | 200/331 |
| 3,004,128 | 10/1961 | Mikolajeski | 200/331 |
| 3,121,778 | 2/1964 | Sander et al. | 200/331 |
| 3,188,439 | 6/1965 | Fullerton | 200/331 |
| 3,301,988 | 1/1967 | Weitzman | 200/315 |
| 3,339,051 | 8/1967 | De Vall | 200/331 |
| 3,581,037 | 5/1971 | Schiffelbein | 200/331 |
| 3,590,648 | 7/1971 | Gorman | 200/331 X |
| 3,892,935 | 7/1975 | Patterson | 200/331 |
| 3,916,134 | 10/1975 | Hansen | 200/331 |
| 4,256,943 | 3/1981 | Whitlock | 200/331 |
| 4,295,026 | 10/1981 | Williams et al. | 200/331 |
| 4,454,401 | 6/1984 | Powis, Jr. | 200/331 |
| 4,455,546 | 6/1984 | Roszel | 200/313 X |
| 4,567,337 | 1/1986 | Woods, I et al. | 200/331 |
| 4,590,345 | 5/1986 | Marshell | 200/331 |
| 4,705,924 | 11/1987 | Hevoyan | 200/331 |

FOREIGN PATENT DOCUMENTS

| | | |
|---|---|---|
| 317613 | 8/1929 | United Kingdom . |
| 655378 | 7/1951 | United Kingdom . |

*Primary Examiner*—Ernest G. Cusick

*Attorney, Agent, or Firm*—Thomas D. Wilhelm

[57] ABSTRACT

A wall switch extension control comprises an elongated rod member having a hole through which the switch lever extends and brackets which resiliently, releaseably, slideably, and frictionally engage the elongated rod member. The elongated rod member can be used to manipulate alternate anglular positions of a pivotal switch lever. The elongated rod member is susceptible of being engaged with the brackets and simultaneously engaged with the switch lever, and of correspondingly simultaneously disengaged from the switch lever and the brackets all in one action and without the use of any tools.

36 Claims, 4 Drawing Sheets

EXTENSION CONTROL FOR A SWITCH

BACKGROUND OF THE INVENTION

This invention relates to the operation of toggle-type wall switches, and the like, by persons who have restricted ability in their access to such switches. It is a general object of this invention to permit children, wheel chair patients, and others with limited arm extension to conveniently manipulate switch toggles which are otherwise out of their reach.

The position of wall switches is generally standardized for the convenience of persons with normal reach. But the positioning of such switches is at a height which is inconvenient and in many cases impossible for operation by children or other persons of small stature, for wheel chair patients, for paraplegics and the like. Accordingly, it is an object of this invention to extend the accessibility of the switch toggle to a position which is more readily accessible to such individuals. The extension is achieved by means of attaching an extension control mechanism to the rigid support to which the switch is mounted, or to the body of the switch itself, and to provide operative means on the control mechanism for manipulating the switch toggle with respect to its angular positions. A number of switch toggle extensions are found in the prior art. Some have been difficult to install. Some have not been easily removable. Some appear to be difficult to operate. For example, U.S. Pat. No. 3,581,037 teaches an extension which is attached to the switch toggle by means of a screw. While the remote end of the extension may be moved into a variety of positions, the complete removal of the extension device from the toggle requires unscrewing the screw from the toggle. U.S. Pat. No. 3,916,134 teaches an extension which is held to the toggle by means of a guide 11. Removal of the extension from the switch requires removal of the guide and its associated mounting screw. U.S. Pat. No. 4,705,924 teaches a flat member 14, having substantial flexibility and resilience, which slides in a guide G and under rails 13. The flat member 14 is engaged with the switch toggle by means of flexing the flat member over the toggle. Removal of the flat member from the toggle, however, requires that the flat member be manually manipulated away from, and over the toggle. Such manipulation especially in removal of the flat member from the toggle requires a significant degree of dexterity on the part of the person attempting to remove the flat member.

While the above switch extensions do provide a degree of operability in that the switch can be operated in each case from a remote position, it would be desirable to have an extension control which can be not only easily manipulated, but which can also be readily temporarily removed, and/or replaced once the holding mechanism has been permanently installed adjacent the switch toggle.

Switch extensions/controls are particularly advantageous for use with small children. Thus it is desirable to be able to emplace the extensions on any particular switch which a child may have use for, especially on a temporary basis. However, in the event where a visiting child of lessor responsibility may be in the same room, it would be desirable to be able to temporarily remove the extension, so that the less responsible child does not have access to use of the switch by means of the extension. When the less responsible child is no longer present, the extension can be replaced. In such circumstances, it is highly desirable that the switch extension be easily removable and easily replaced.

Thus it is an object of this invention to provide a switch extension which can be readily removed, and subsequently replaced, with only modest effort, and no requirement for use of tools.

It is a further object to provide a switch extension which requires minimal dexterity for either the attachment of the extension to the switch and its permanently mounted holding means, or the removal of the extension from the switch after it has been emplaced.

SUMMARY OF THE INVENTION

These and other objects are seen to be obtained in an extension control for a switch which is mounted to a rigid support means, the switch having a pivotal switch lever capable of being manipulated into alternate angular positions to thereby operate the switch. The extension mechanism comprises an elongated rod member having an annular engaging member comprising a hole through which the switch lever can extend. The annular member has spaced apart portions defining spaced edges around the hole for respective abutment against, and engagement with, opposing surfaces of the switch lever. The rod further comprises a first retainer means.

The extension control further comprises a bracket means mountable to the rigid support means to which the switch is mounted, optionally through the switch body, itself. The bracket comprises a second retainer means. The first and second retainer means are cooperatively configured such that they are engaged to each other, at a locus of engagement, with accompanying resilient deformation of at least one of the first and second retainer means, engageable when the bracket is mounted to the rigid support means. The first and second retainer means are frictionally and slideably held to each other when they are so engaged. Thus the rod and the bracket are held together, and the hole can be positioned for engagement with the switch lever, both being effected by the engagement of the first and second retainer means. While the first and second retainer means are so engaged, the rod can slide relative to the bracket for engagement of the edges of the annular engaging member with corresponding ones of the surfaces of the switch lever, to thus manipulate the switch lever while the first and second retainer means are engaged. Further, the rod is releasable from the bracket and from being positioned for engagement of the edges of the annular member with the switch lever, by resilient deformation of one or more of the retainer means at the locus of the engagement.

Preferably the first retainer means on the rod member comprises a constant cross section portion of the rod member, and the second retainer means on the bracket comprises a concavity. The concavity preferably has an opening directed away from the rigid support means when the bracket is mounted to the rigid support means. In this embodiment the rod is frictionally held in the concavity and slides in the bracket for the recited engagement of the edges of the annular engaging member with the corresponding ones of the surfaces of the switch lever.

Desirably the rod has definable first and second ends, the annular member is positioned toward the first end, and the bracket is positioned adjacent the annular member, between the annular member and the second end.

In preferred embodiments, the invention includes a second bracket spaced from the first bracket and comprising a third retaining means which cooperates with a fourth retaining means on the rod. Both of the brackets are mounted to the rigid support means and are resiliently and releasably engageable with the rod member, and are frictionally and slideably held in engagement with the rod member. The third and fourth retainer means may be patterned after the configurations of the first and second retainer means.

In highly preferred embodiments of the invention, two brackets are positioned on opposing sides of the annular member, with the annular member between them, such that the holding of the rod by the brackets places the rod in a position such that the edges around the annular engaging member are held in cooperative proximity with the switch lever. Desirably the annular member, the hole, the rod, and the brackets are cooperatively configured, and with relationship to the switch lever, such that the rod is releasably disengaged from at least one of the brackets before the switch lever is disengaged from the hole.

In some highly preferred embodiments of the invention the rod has definable first and second ends, and that portion of the rod extending from one of the ends through at least a portion of the edges of the hole is transparent to light. Thus, when the control is used with a switch having a lighted switch lever, light from the switch lever is transmitted through the transparent portion of the rod to the one end of the rod and that end of the rod is thus lighted by the lighted switch lever and is visible in the dark. Preferably the extension rod is made of plastic composition, especially where the rod is intended to be transparent to transmission of light from the lighted switch lever.

In some embodiments the rod is mounted by a bracket means which comprises a pair of spaced brackets and an intermediate spacing member for spacing the brackets relative to each other and such that the engaging member on the rod is between the brackets, when the rod is installed in the brackets, and in engaging proximity with the switch lever. The rod is releasable from both brackets by resilient deformation of one or more of the rod and the brackets at the respective loci of the engagement.

The most preferred embodiments of the invention include at least two brackets, positioned on opposing sides of the annular member. The brackets may, for example, be mounted by means of the typical mounting screws attaching a switch cover plate to the switch which is mounted to the rigid support means. In some cases it is desirable to include a third bracket attached to, for example, the same rigid support means, but closer to the end of the extension rod which is more remote from the switch, and adapted for manipulation by a person's hand.

DETAILED DESCRIPTION OF THE ILLUSTRATED EMBODIMENTS

Figure 1:
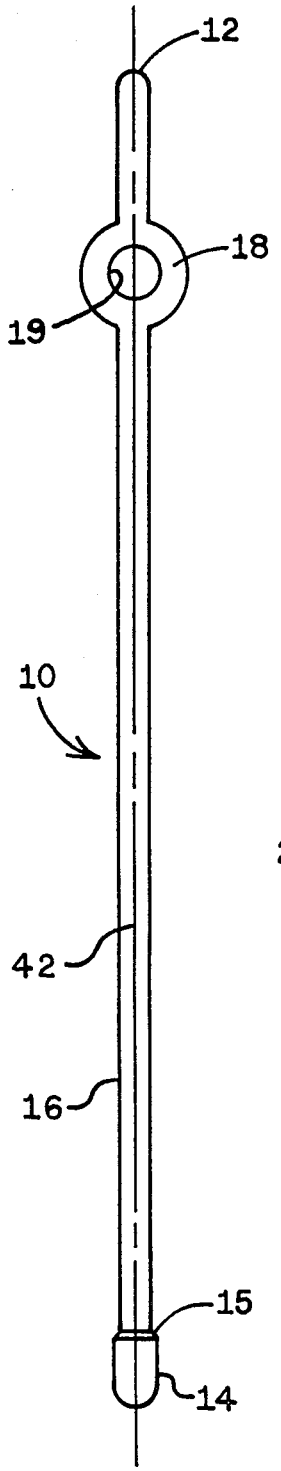
FIG. 1 shows a pictorial view of an elongated rod member used in the extension control of the invention.

Turning now to the drawings, FIG. 1 shows the elongated rod member 10 which has an upper end 12, a lower end 14 and an intermediate portion 16. Annular engaging member 18 is between the upper end 12 and the intermediate portion 16, and defines a hole 19.

Figure 2:
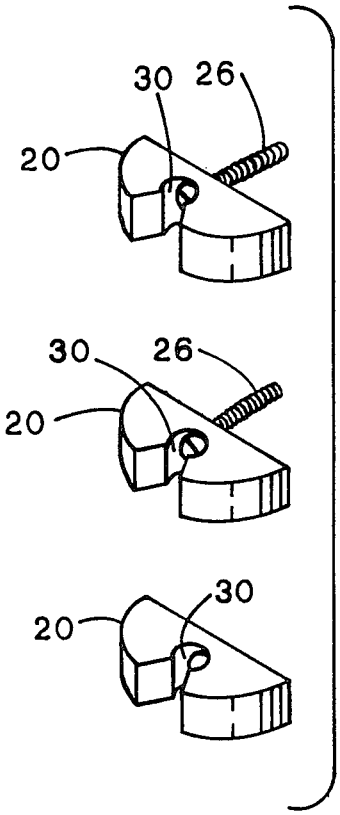
FIG. 2 spacially shows three of the brackets of the preferred embodiment of the invention.
Figure 3:
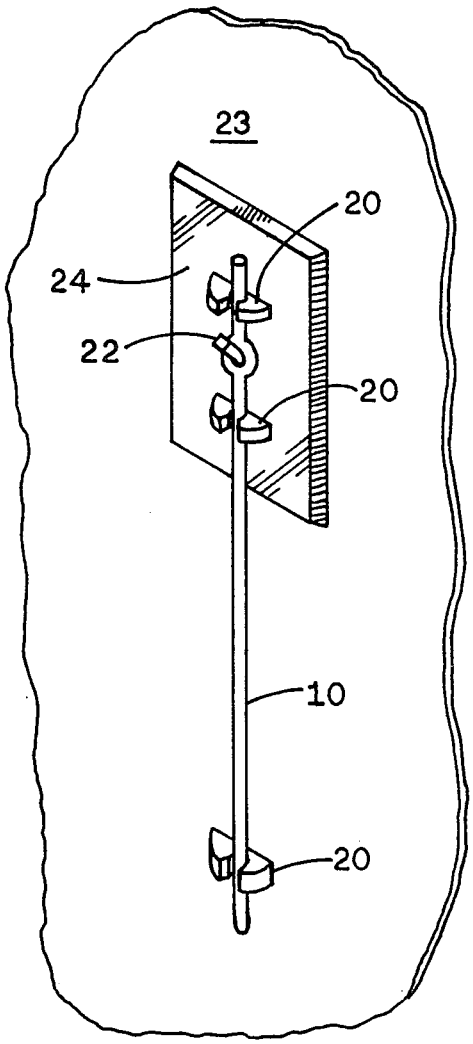
FIG. 3 shows the extension control mechanism of the invention mounted to a switch cover plate and emplaced for controlling the switch.
Figure 4:
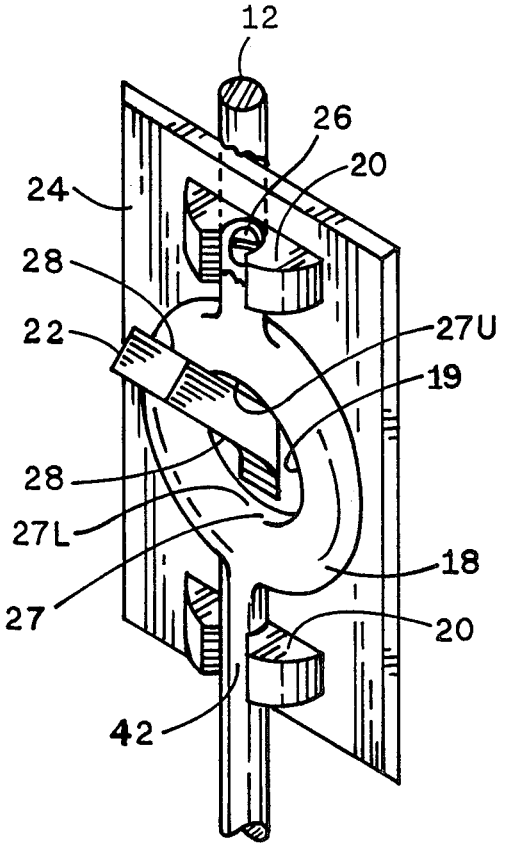
FIG. 4 shows an enlarged view of the upper end of the elongated rod member, and especially the relationship of the hole to the switch lever, and the holding of the rod by the brackets.

FIG. 2 shows three of the brackets 20 as they are used in the preferred embodiments of the invention, for holding the rod member 10 in its appropriate relationship with the switch lever 22. Brackets 20 are mounted to a rigid support means, such as the wall 23, through switch cover plate 24, using mounting screws 26 which concurrently mount the cover plate to the wall, and accordingly to the switch box. Typically, two of the brackets 20 are mounted to the wall through the switch cover plate 24 by screws 26, as shown in FIG. 4, which mount both the brackets 20 and the cover plate 24 to the switch. Screws 26 typically use the ordinary mounting holes in the switch body in attachment of the cover plate and the brackets. The switch is accordingly usually mounted to the wall by means of the conventional switch box. As seen in FIG. 3, a third bracket may be attached to the wall below the switch cover plate, and used to hold the lower end of the extension rod. A screw, along with any necessary adapter appropriate to the material to which the lower bracket is mounted, is selected and used for that mounting purpose.

The switch lever 22 shown represents the usual external control mechanism for operation of the switch. The switch is thus mounted to the wall, which is a rigid support means. And the extension control which comprises the elongated rod member 10 and the brackets 20, is thus mounted to the rigid support means of the wall by means of the screws 26 extending through the brackets, through the switch cover plate 24 and accordingly mounting to the switch, which is, as indicated earlier, mounted to the wall through the switch box.

With the extension control thus in place, the switch lever 22 can be manipulated into its alternate angular positions to thus operate the switch to its "ON" position and correspondingly to its "OFF" position.

Referring now to FIG. 4, the annular member 18 has spaced upper and lower edges 27 which abut, and thus engage, opposing surfaces 28 of the switch lever 22 in operation of the switch. Thus the annular member 18 is so configured as to provide a cooperative proximity between the inner spaced edges 27 and the corresponding opposing surfaces 28 of the switch lever.

As seen in FIG. 4, the switch lever is in the position which conventionally indicates that a single pole switch is turned on. In operation of the switch control, to thus operate the switch by a person, typically a young child, unable to reach the switch lever 22, the elongated rod member 10 is grasped at its lower end 14 and is pulled downwardly. As the rod is pulled downwardly, the upper inner edge 27U of annular member 18 is displaced against the corresponding upper surface 28 of the switch lever 22. As the rod is pulled downwardly, the inner edge 27U of the annular member 18 pushes against the upper surface of switch lever 22 and forces the lever downwardly, thus turning off the switch. To turn the switch back on, the rod is pushed upwardly, whereby the switch lever is engaged by lower inner edge 27L and is again returned to the upper position as seen in the drawings.

As seen in FIG. 2, each bracket 20 comprises a concavity 30 which houses the head of a mounting screw 26. However, the head of the mounting screw is recessed below the surface of the concavity 30, and the concavity 30 is configured according to the configuration of the corresponding portion of the rod 10 as follows. The concavities in brackets 20 are configured such that they are able to receive and hold the corresponding portion of the rod 10. Essentially, the concavities 30 serve as a retainer means to retain the rod 10. Accordingly, the rod and the brackets are cooperatively configured such that the rod can be resiliently received in the brackets and frictionally held in the brackets such that a modest amount of force will cause the rod to slide in the concavities 30; and also with sufficient friction in the holding of the rod in the concavities that the rod will not slide in the brackets without the exertion of an outside force in addition to gravity. Thus the rod is frictionally and slideably held in the brackets.

As the rod is engaged in a bracket, there is an accompanying resilient deformation of either or both of the rod or the associated bracket. Typically, the bracket will deform slightly as the rod is inserted. Such deformation, however, is a resilient deformation such that the bracket returns to its original shape at the point that the deforming force is removed. Since the brackets and the rod are so configured, the rod can easily be snapped into the brackets for use, and then can be easily removed by a moderate pulling force, for example on the lower end 14 of the rod, which snaps the rod out of the bracket.

It is seen from the several FIGURES which show the assembly of the extension control to the switch lever 22, that the annular member 18 is brought into engaging proximity with the lever 22 during, and slightly before the engagement of the rod with the brackets 20. Thus, as seen in FIG. 4, the switch lever first extends through the hole 18, and then the rod is engaged with the brackets; all in the process of attaching the rod to the brackets. The brackets are more or less permanently mounted to the wall, or the switch cover, with the screws, preferably in such an orientation that the opening of the concavity in the bracket is directed away from the wall. Once the brackets have been mounted, the rod can readily be snapped into place with the switch lever 22 extending through hole 19, and without the necessity of using any tools or any exacting finger dexterity. The rod can also be readily detached from the brackets, and accordingly from the switch lever, by simply pulling the rod away from the wall. For example the rod may be grasped at its lower end 14 and pulled away from the wall. As the rod is pulled away from the wall, it will first pull out of the lower bracket 20. A further pulling of the rod away from the wall will disengage it from the bracket below the switch lever (FIG. 3), with the annular member 18 and hole 19 being pulled part way out from the switch lever 22. A further pulling of the rod 10 away from the wall finally pulls the annular member 18 away from the switch lever 22 along with the associated release of the upper portion of the rod from the upper bracket 20.

Figure 5:
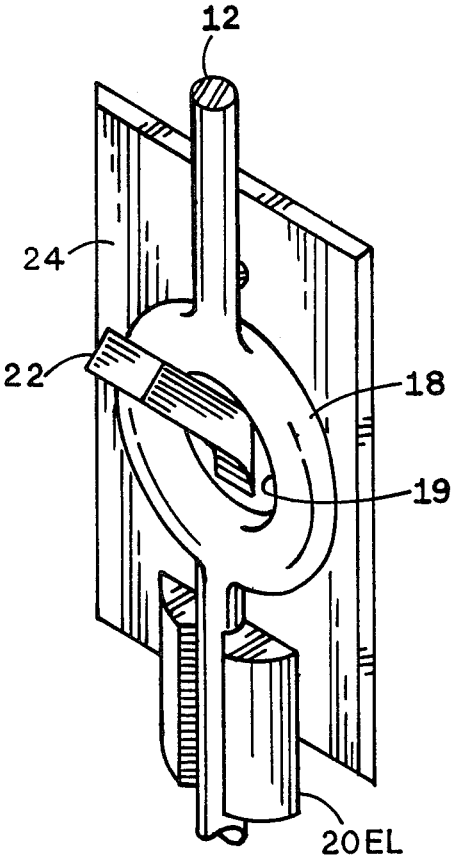
FIG. 5 shows an enlarged view of an extension control of the invention which uses a single bracket to hold the elongated rod.

FIG. 5 shows an alternate embodiment of the invention in which the extension control comprises only a single bracket 20EL. Bracket 20EL is elongated as compared to the brackets 20 shown in FIGS. 2–4. The longer length of bracket 20EL provides for appropriate stability of the rod with respect to its length. The operation of the rod will be the same as in the embodiment shown in FIGS. 3 and 4. The rod and bracket will be similarly engaged with each other, with only one bracket needing engagement.

Returning now to FIGS. 1, 2, and 4, it is seen that the combination of the rod 10 and a bracket 20 essentially comprises a female retainer means in concavity 30 on the bracket which receives a male retainer means in the form of the round cross-section of the associated portion of the rod.

Figure 7:
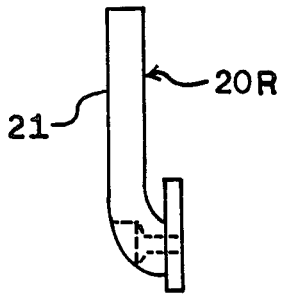
FIG. 7 shows a side view of a bracket of FIG. 6.
Figure 6:
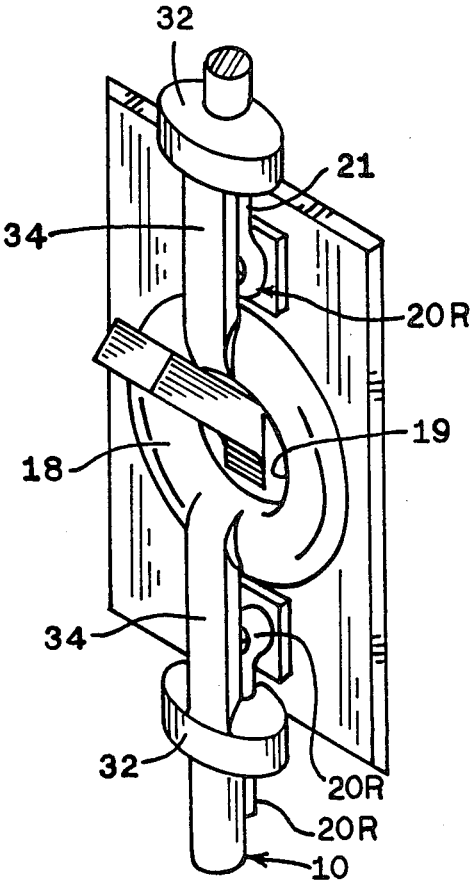
FIG. 6 shows an alternate embodiment in which portions of the brackets serve as male retainer members and portions of the rod serve as corresponding female retainer members.

FIG. 6 shows a reversal of the roles of retaining means with respect to the rod 10 and the brackets. A side view of the brackets 20R used in FIG. 6 is shown in FIG. 7. Referring back now to FIG. 6, the brackets 20R serve as a male retainer means and are received into the female adapters 32 on the upper portion of rod 10. Essentially the female adapters 32 serve as female retainer means with respect to the male retainer function of the rod portion of the brackets 20R. In operation, then, the female adapters 32 slide on the rod portions 21 of the male adapter brackets 20R in much the same manner that the rod of FIG. 4 slides in the concavity 30 of the bracket 20. Accordingly, the upper portion of rod 10 is adapted for clearance of the female adapters 32 over the brackets 20R. In that regard, special bars 34 connect the adapters 32 to the annular member 18, and through annular member 18 to each other. A third lower bracket may be the same as a bracket 20R seen in FIGS. 6 and 7, or may be constructed as for example bracket 20 seen in FIGS. 2 and 3.

Figure 8:
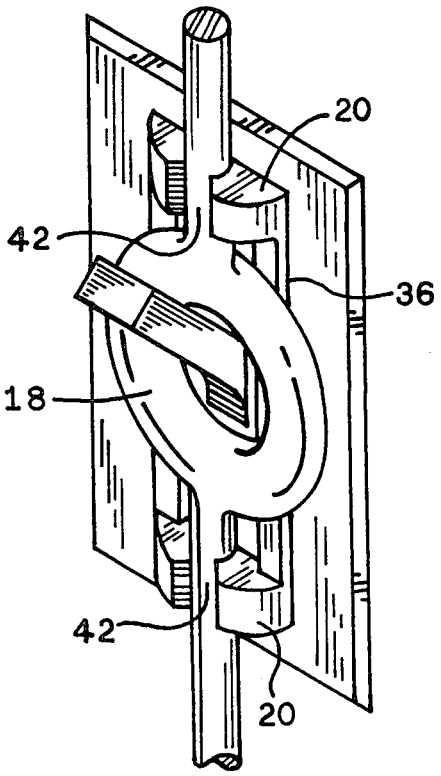
FIG. 8 shows an enlarged view as in FIGS. 4–6 and wherein in the brackets are held in spaced relationship by an intermediate spacing member.

In a further embodiment of the invention shown in FIG. 8, the brackets 20 are held in spaced relationship to each other by an intermediate spacing member 36 which extends between them.

Figure 9:
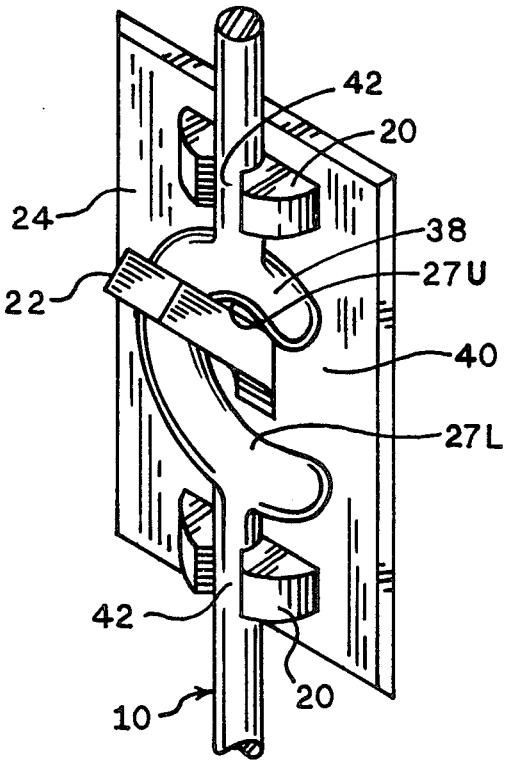
FIG. 9 shows an alternate construction for the annular member.

In still another embodiment seen in FIG. 9, annular member 18 has been replaced by double hook 38 which looks and operates much like annular member 18 except that it represents an open, or incomplete annular shape. The opening 40 can be advantageous in facilitating initial engagement of lever 22 as the rod 10 is being emplaced over lever 22 and engaged in brackets 20. Thus the term "annular member" as used herein includes any engaging member such as double hook 38 defining effective portions of an enclosing perimeter at the upper and lower edges 27. The shape of structure for connecting upper and lower edges 27U and 27L is not important so long as it does not interfere with the operation of the switch, and may include one or more openings as at 40 in FIG. 9. Preferably, but not of necessity, annular member 18 and rod 10 are contained within a common plane.

It is seen from the disclosure of the operation of the various embodiments of the invention that the male retainer means on the respective one of the rod and the brackets has a constant cross-section over that portion of the male retainer means which is slideably to be engaged with the female retainer means. The combination of the male and female retainer means comprises the functional joinder means. For example, as seen in FIG. 4, those portions of the elongated rod member 10 which are engageable with the brackets 20, at the separate illustrated locations 42 along the longitude of the rod, as the rod slides up and down in the brackets for manipulation of the switch lever, have constant cross-sections. There can be surface deformities and depressions in that constant cross-section, but there must be an effective constant cross-section as far as engagement with the concavity 30 of the brackets. Accordingly, in the embodiment of FIG. 6, the elongated rod-like portion 21 of the brackets 20R has a constant cross-section for that portion of the elongated rod-like member which is to be engaged with the adapters 32 on the rod 10.

It is further seen from the above discussion that the release from the brackets and the release of the cooperative relationship between the annular member 18 and the switch lever 22 can be effected as part of a single action of removing the rod from the brackets. Namely the rod can be removed from the brackets and removed from the switch lever in a single coordinated and continuing action of pulling the rod away from the wall.

While the embodiments shown indicate that brackets are to be mounted to the switch cover plate, it would be equally acceptable to mount the brackets on the wall if the cover plate is not considered an appropriate mount. Thus, referring to FIG. 3, the brackets 20 could be mounted above and below the cover plate 24, with rod 10 being further lengthened accordingly. They could further be mounted only below the cover plate, or only above the cover plate. It is only critical that the brackets used for holding the rod be rigidly mounted in such a position and in such a location that they can position annular member 18 with respect to its engagement with the lever 22. Thus a rigid mounting means is required for the brackets. The mounting means is usually the same rigid mounting means on which the switch is mounted. It can alternatively be some other mounting means. The degree of rigidity required of the mounting means is that rigidity which will stabilize the extension control sufficiently that the switch can be operated.

Benefically, both the brackets 20 and the rod member 10 are preferred to be fabricated from a resilient material which is easily fabricated and formed into the desired shape. Preferred are the thermoplastic polymers, such as polyethylene, polypropylene, polyvinyl chloride, nylon, polycarbonate, acrylics and the like. While the particular selection of materials is not critical, it is important that the materials selected be compatible with the purposes of the invention. Thus the rod should be relatively rigid, but able to flex in the normal engagement of the rod and the brackets. In general, the brackets will do the majority of the flexing for the preferred embodiments contemplated herein when the rod is engaged with the brackets. However it is also helpful if the rod has resilient properties of its own. The rod should be flexible enough that it can be engaged individually into the brackets one at a time as the rod is being mounted. Accordingly it should be rigid enough that it can be pushed up and pulled down without bending so much as to prevent the manipulation of the switch.

With respect to the engagement of the rod 10 with the brackets 20, it is a requirement of the material and the configuration of the rod that the rod must be disengageable from the brackets before the rod is permanently bent beyond its Young's modulus deformation, or is otherwise damaged by attempts to disengage it from the brackets.

The lower end 14 of the rod 10 is preferably enlarged to aid in grasping the rod for operation of the switch. In the preferred embodiment, the lower end 14 is specifically adapted in size and shape such that an average 18 month old child can grasp the end 14 with sufficient strength and dexterity to operate the switch, but will not have sufficient strength to pull the rod downwardly and out of the brackets 20. To that end, in the preferred embodiment, the main body of the rod, as at 16 in FIG. 1, has a nominal diameter of about ¼ inch. The enlarged lower end 14 has a nominal diameter of ⅜ inch and a nominal length of ½ inch, with a nominal 45° bevel 15 between the ¼ inch portion and the ⅜ inch portion. The longitudinal central axis of enlarged end 14 comprises an extension of the longitudinal central axis 42 of the main body 16 of the rod. Thus the perimeter of enlarged end 14 is concentric with the outer perimeter of the main body 16 of the rod. Thus the bevel 15 comprehends a lateral step of half the difference in the respective diameters: thus a lateral step of 1/32 to 3/32 inch.

With the rod structure thus specified, an 18 month old child can grasp end 14 with sufficient strength to operate the switch, whereby the enlargement of end 14 and the bevel 15 aid in the grasping for the modest pulling necessary for operation of the switch.

Equally as important, should the 18 month old child attempt to pull more strongly on the end 14 of the rod 10, thus potentially pulling the rod out of the brackets, the 45° angle of bevel 15 urges slippage of the gripping part of the child's hand such that it slips down onto enlarged end 14 and thus off the rod.

Conversely, if bevel 15 is omitted, such that the rod diameter undergoes a step change, without the bevel transition, the child can more easily grip rod end 14, having at least one gripping finger at or above the step change, and thereby exert an undesirably strong grip.

Thus is the overall combination of dimensions significant when the rod is to be used with a young child. Especially the diameters of the main rod and the lower end should be as specified, with a tolerance of no more than plus ¼ inch, minus ⅛ inch giving a diameter range of about ¼ inch to about ⅜ inch. The difference between the diameter of the main rod and the diameter of the lower end 14 should be in the range of 1/16 inch to 3/16 inch, in order to function as intended with a young child. Shapes other than round cross-sections are acceptable so long as they are in the same general size range, and have the same bevel step of 1/32 inch to 3/32 inch as corresponds to the step in a round rod having the recited diameter differences. The angle on bevel 15 is preferably about 45° , but can vary between about 30° and about 60° . The length of the enlarged end 14 is less critical, but is preferably at least ¼ inch, preferably no more than 1 inch.

A further function of the rod can be in its visibility. It is preferred that the portion of the rod between lower end 14 and the edges of the annular member 18 be transparent to light. In those embodiments which are transparent to light, and wherein the rod is used with a switch which has a lighted lever 22, then the light from the switch is picked up by the edges of the engaging member and transmitted through the rod to its lower end 14; with the objective that the lower end 14 of the rod glows with the light provided by the illuminated switch lever 22. The degree of illumination in the end 14 is a function of the ability of the rod to transmit the light.

Thus the invention provides a novel wall extension control which can be emplaced and removed readily and with moderate amounts of effort without the necessity to employ tools or any particular finger dexterity in mounting or removing the extension.

Those skilled in the art will now see that certain modifications can be made to the wall switch extension herein disclosed with respect to the preferred embodiments, without departing from the spirit of the instant invention. And while the invention has been described above with respect to its preferred embodiments, it will be understood that the invention is capable of numerous rearrangements, modifications and alterations, and all such arrangements, modifications and alternations are intended to be within the scope of the appended claims.

Having thus described the invention, what is claimed is:

1. An extension control for a switch, wherein a switch is mounted to a rigid support means and having a switch lever capable of being manipulated into alternate positions to thereby operate said switch, said extension control comprising:

(a) an elongated rod member comprising an engaging member, said engaging member having spaced edges for respective engagement with corresponding surfaces of said switch lever, said rod member comprising a first retainer means; and (b) a first bracket means mountable to said rigid support means, said first bracket means comprising a second retainer means;

said first and second retainer means being cooperatively configured such that they can be engaged to each other, at a locus of engagement, said first and second retainer means being frictionally and slideably held to each other when said first and second retainers means are engaged, whereby said rod member and said first bracket means can be held together, and said engaging member can be positioned in cooperative operative engagement with said switch lever, by the engagement of said first and second retainer means, and said rod member can slide relative to said first bracket means for engagement of said edges of said engaging member with corresponding ones of said surfaces of said switch lever, to thus manipulate said switch lever while said first and second retainer means are engaged, said rod member being releasable from said first bracket means and from being positioned for engagement of said edges of said engaging member with said switch lever, by resilient deformation of one or more of said retainer means at said locus of engagement, in effecting the release of said rod member from said first bracket means.

2. An extension control as in claim 1 wherein said first retainer means on said rod member comprises a first constant cross-section portion of said rod member and wherein said second retainer means on said first bracket means comprises a concavity, said concavity having an opening directed away from said rigid support means when said first bracket means is mounted to said rigid support means, whereby said rod member is frictionally held in said concavity and can slide in said first bracket means for the engagement of said edges of said engaging member with corresponding ones of said surfaces of said switch lever.

3. An extension control as in claim 2 wherein said rod member has first and second ends, wherein said engaging member is positioned toward said first end and wherein said first bracket means is positioned adjacent said engaging member and between said engaging member and said second end.

4. An extension control as in claim 3 and including a second bracket means spaced from said first bracket means, and cooperating with a second constant cross-section portion of said rod member, said first and second bracket means being mounted to said rigid support means and being resiliently, and frictionally engaged with said rod member, said first bracket means being engaged at a first longitudinal location on said rod member, said second bracket means being engaged at a separate longitudinal location on said rod member.

5. An extension control as in claim 4 said first and second bracket means being positioned on opposing sides of said engaging member, such that said first and second bracket means hold said rod member in a position such that said edges of said engaging member are in cooperative engaging proximity with said switch lever, the cooperative configurations of (i) said switch lever, (ii) said engaging member, (iii) said rod member and (iv) said first and second bracket means being such that said rod member is releaseably disengaged from at least one of said bracket means before said edges are released from said cooperative engaging proximity with said switch lever.

6. An extension control as in claim 3 wherein said rod member is plastic.

7. An extension control as in claim 2 and including a second bracket means spaced from said first bracket means, and cooperating with a second constant cross-section portion of said rod member, said first and second bracket means being mounted to said rigid support means and being resiliently, and frictionally engaged with said rod member, said first bracket means being engaged at a first longitudinal location on said rod member, said second bracket means being engaged at a second separate longitudinal location on said rod member.

8. An extension control as in claim 7 said first and second bracket means being positioned on opposing sides of said engaging member, said engaging member being disposed between said first and second bracket means, said first and second bracket means holding said rod member in a position such that said edges of said engaging member are in cooperative proximity with said switch lever.

9. An extension control as in claim 7 wherein said rod member is plastic.

10. An extension control as in claim 2 wherein said rod member has first and second ends and wherein a portion of said rod member extending from one said end through at least a portion of at least one of said edges is transparent to light, said control, when used with a switch having a lighted switch lever, glows at said one end of said rod member, and is visible in the dark.

11. An extension control as in claim 2 wherein said rod member is plastic.

12. An extension control as in claim 1 wherein said rod member has first and second ends, wherein said engaging member is positioned toward said first end and wherein said first bracket means is positioned adjacent said engaging member and between said engaging member and said second end.

13. An extension control as in claim 12 and including a second bracket means spaced from said first bracket means, and cooperating with a second constant cross-section portion of said rod member, said first and second bracket means being mounted to said rigid support means and being resiliently, and frictionally engaged with said rod member, said first bracket means being engaged at a first longitudinal location on said rod member, said second bracket means being engaged at a second separate longitudinal location on said rod member.

14. An extension control as in claim 13 said first and second bracket means being positioned on opposing sides of said engaging member, such that said first and second bracket means hold said rod member in a position such that said edges of said engaging member are in cooperative engaging proximity with said switch lever, the cooperative configurations of (i) said switch lever, (ii) said engaging member, (iii) said rod member and (iv) said first and second bracket means being such that said rod member is releaseably disengaged from at least one of said bracket means before said edges are released from said cooperative engaging proximity with said switch lever.

15. An extension control as in claim 14 wherein said rod member is plastic.

16. An extension control as in claim 12 wherein said rod member is plastic.

17. An extension control as in claim 1 and including a second bracket means spaced from said first bracket means, said second bracket means comprising a third retainer means, said second bracket means cooperating with a fourth retainer means on said rod member, both said first and second bracket means being mounted to said rigid support means and being resiliently, and frictionally engaged with said rod member, said first bracket means being engaged at a first longitudinal location on said rod member, said second bracket means being engaged at a second separate longitudinal location on said rod member.

18. An extension control as in claim 17 said first and second bracket means being positioned on opposing sides of said engaging member, said engaging member being disposed between said first and second bracket means, said first and second bracket means holding said rod member in a position such that said edges of said engaging member are in cooperative proximity with said switch lever.

19. An extension control as in claim 18 wherein said rod member is plastic.

20. An extension control as in claim 17 wherein said rod member is plastic.

21. An extension control as in claim 1 wherein said rod member has first and second ends, and wherein a portion of said rod member extending from one said end through at least a portion of at least one of said edges is transparent to light, said control, when used with a switch having a lighted switch lever, glows at said one end of said rod member, and is visible in the dark.

22. An extension control as in claim 21 wherein said rod member is plastic.

23. An extension control as in claim 1 wherein said rod member is plastic.

24. An extension control as in claim 1 wherein said rod member is releasable from said first bracket means and from being positioned for engagement of said edges of said engaging member with said switch lever, by resilient deformation of one or more of said first and second retainer means at said locus of engagement.

25. An extension control as in claim 1, said first bracket means holding said rod member in a position such that said edges of said engaging member are in cooperative operative engagement with said switch lever, the cooperative configurations of (i) said switch lever, (ii) said engaging member, (iii) said rod member and (iv) said first bracket means being such that said rod member is releasably disengaged from at least part of said first bracket means before said edges are released from said cooperative operative engagement with said switch.

26. An extension control as in claim 1, and including a second bracket means spaced from said first bracket means, and cooperating with a second constant cross-section portion of said rod member, said first and second bracket means being mounted to said rigid support means and being resiliently, and frictionally engaged with said rod member, said first and second bracket means holding said rod member in a position such that said edges of said engaging member are in cooperative operative engagement with said switch lever, the cooperative configurations of (i) said switch lever, (ii) said engaging member, (iii) said rod member and (iv) said first and second bracket means being such that said rod member is releaseably disengaged from at least part of said first and second bracket means before said edges are released from said cooperative operative engagement with said switch.

27. An extension control for a switch, wherein a switch is mounted to a rigid support means and having a switch lever capable of being manipulated into alternate positions to thereby operate said switch, said extension control comprising:

(a) an elongated rod member comprising an engaging member, said engaging member having spaced edges for respective engagement with opposing surfaces of said switch lever, said rod member having at least one constant cross-section portion; and (b) bracket means mountable to said rigid support means, said bracket means comprising a pair of spaced brackets and an intermediate spacing member for spacing said brackets relative to each other, each said bracket comprising a concavity capable of separately and resiliently gripping said rod member at at least one constant cross-section portion along the length of said rod member, said concavities on said brackets and said corresponding constant cross-section portions of said rod member being cooperatively configured such that said constant cross-section portions of said rod member, and corresponding ones of said concavities, can be releaseably and frictionally engaged to each other, at respective loci of engagement, in said concavities, with concurrent engagement of said switch lever with said engaging member said rod member being releasable from said brackets by resilient deformation, at said loci of engagement, of one or both of (i) the corresponding one of said brackets and (ii) that portion of said rod member which is frictionally engaged with the corresponding one of said brackets.

28. An extension control as in claim 27 said brackets holding said rod in a position such that said edges of said engaging member are in cooperative engaging proximity with said switch lever, the cooperative configurations of (i) said switch lever, (ii) said engaging member, (iii) said rod member and (iv) said brackets being such that said rod member is releasably disengaged from at least one of said brackets before said edges are released from said cooperative engaging proximity with said switch lever.

29. An extension control as in claim 28 said engaging member being positioned between said brackets.

30. An extension control as in claim 27 wherein said rod member has first and second ends and wherein a portion of said rod member extending from one said end through at least a portion of at least one of said edges of said engaging member is transparent to light, said control, when used with a switch having a lighted switch lever, glows at said one end of said rod member, and is visible in the dark.

31. An extension control for a switch as in claim 27 wherein said rod member is frictionally and slideably held in said concavities and can slide in said brackets in cooperative operative engagement of said edges of said engaging member with corresponding ones of said surfaces of said switch lever, to thus manipulate said switch lever while said rod member is engaged in said brackets.

32. An extension control as in claim 27, said engaging member being disposed between said brackets.

33. An extension control as in claim 27, said engagements of said concavities and said rod member being accompanied by resilient deformation, at said loci of engagement, of one or both of (i) the corresponding one of said brackets and (ii) that portion of said rod member which is frictionally engaged with the corresponding one of said brackets.

34. An extension control for a switch which is mounted to a rigid support means, wherein a switch includes a switch lever capable of being manipulated into alternate positions to thereby operate said switch, said extension control comprising:

(a) an elongated rod member comprising an engaging member said engaging member having spaced edges for respective engagement with opposing surfaces of said switch lever, said rod member comprising a first retainer means, and first and second ends, said first end comprising a first main rod portion; a second enlarged portion, and an intervening lateral bevel step of 1/32 inch to 3/32 inch between said second enlarged portion and said first main rod portion, the angle of said bevel being between about 30° and about 60°; and (b) bracket means mountable to said rigid support means, said bracket means comprising a second retainer means, said first and second retainer means being cooperatively configured such that they can be releaseably engaged when said bracket means is mounted to said rigid support means, and frictionally and slideably held when said first and second retainer means are engaged, whereby said rod member and said bracket means can be held together, and said engaging member can be positioned for engagement of said switch lever, by the engagement of said first and second retainer means, and said rod member can slide relative to said bracket means for engagement of said edges of said engaging member with corresponding ones of said surfaces of said switch lever, to thus manipulate said switch lever while said first and second retainer means are engaged.

35. An extension control as in claim 34 wherein said second enlarged portion has a cross-section corresponding to a diameter of between about $\frac{1}{4}$ inch and about $\frac{5}{8}$ inch.

36. An extension control as in claim 34 wherein said first main rod portion has a diameter of about $\frac{1}{4}$ inch, said second enlarged portion has a diameter of about $\frac{3}{8}$ inch, and wherein said bevel is about 45°.

* * * * *